US007654313B2

(12) United States Patent
Angman

(10) Patent No.: US 7,654,313 B2
(45) Date of Patent: Feb. 2, 2010

(54) METHOD AND ASSEMBLY FOR CASING HANDLING USING A KELLY RIG

(75) Inventor: Per G. Angman, Calgary (CA)

(73) Assignee: Tesco Corporation, Calgary, AB (CA)

( * ) Notice: Subject to any disclaimer, the term of this patent is extended or adjusted under 35 U.S.C. 154(b) by 357 days.

(21) Appl. No.: 11/672,927

(22) Filed: Feb. 8, 2007

(65) Prior Publication Data

US 2007/0209805 A1 Sep. 13, 2007

Related U.S. Application Data

(60) Provisional application No. 60/766,728, filed on Feb. 8, 2006.

(51) Int. Cl.
*E21B 19/18* (2006.01)

(52) U.S. Cl. ..... 166/77.51; 166/85.1; 166/75.14; 166/380; 166/78.1; 175/122; 175/162

(58) Field of Classification Search ..... 166/77.1, 166/96.1, 85.1, 75.14, 77.51, 379, 380, 78.1; 175/220, 122, 162, 203; 464/163
See application file for complete search history.

(56) References Cited

U.S. PATENT DOCUMENTS

| | | | |
|---|---|---|---|
| 1,833,134 | A | 11/1931 | Stokes |
| 3,249,162 | A | 5/1966 | Brown |
| 3,603,412 | A | 9/1971 | Kammerer et al. |
| 3,706,347 | A | 12/1972 | Brown |
| 3,766,991 | A | 10/1973 | Brown |
| 3,780,883 | A | 12/1973 | Brown |
| 3,915,244 | A | 10/1975 | Brown |
| 4,153,121 | A | 5/1979 | Allan |
| 4,274,778 | A | 6/1981 | Putnam et al. |
| 4,470,470 | A | 9/1984 | Takano |
| 4,550,392 | A | 10/1985 | Mumby |
| 4,616,719 | A | 10/1986 | Dismukes |

(Continued)

FOREIGN PATENT DOCUMENTS

| | | |
|---|---|---|
| WO | WO 98/11322 IB | 3/1998 |

(Continued)

OTHER PUBLICATIONS

Society of Petroleum Engineers, SPE/IADC 52770 Case Running Tool by G. H. Kamphorst, G. L. van Wecham, W. Boom, D. Bottger, K. Koch; pp. 89-97, 1999.

*Primary Examiner*—David J Bagnell
*Assistant Examiner*—Sean D Andrish
(74) *Attorney, Agent, or Firm*—Bracewell & Giuliani LLP

(57) ABSTRACT

A method for converting a kelly rig for handling casing includes the formation of a torque reaction guide with elongate members available at a drill site including for example, any of drill collar stands, casing strings, drill pipe stands and cables held in tension. A method for converting a kelly rig for handling casing may include the step of installing a torque reaction guide in a simple way, such as by securing the track to the monkey board. In one embodiment a torque reaction frame is used for securing between a torque generating device and a torque reaction guide that operates in a float mode to allow for misalignment of the torque reaction guide relative to the well hole center.

14 Claims, 6 Drawing Sheets

U.S. PATENT DOCUMENTS

| | | | |
|---|---|---|---|
| 4,625,796 | A | 12/1986 | Boyadjieff |
| 4,646,856 | A | 3/1987 | Dismukes |
| 4,651,837 | A | 3/1987 | Mayfield |
| 5,107,940 | A | 4/1992 | Berry |
| 5,197,553 | A | 3/1993 | Leturno |
| 5,433,279 | A | 7/1995 | Tessari et al. |
| 6,276,450 | B1 | 8/2001 | Seneviratne |
| 6,527,047 | B1 | 3/2003 | Pietras |
| 7,140,443 | B2 | 11/2006 | Beierbach et al. |

FOREIGN PATENT DOCUMENTS

| | | |
|---|---|---|
| WO | WO 99/30000 IB | 6/1999 |

METHOD AND ASSEMBLY FOR CASING HANDLING USING A KELLY RIG

FIELD

The invention relates to methods and assemblies for handling the drilling and running of wellbore tubulars and, in particular, of handling casing.

BACKGROUND

Casing handling, such as drilling and running, has been advanced by the assignee of the present invention generally by use of a rig including a top drive. Many rigs, however, are not equipped with a top drive. Instead many rigs operate by use of a kelly to apply torque to the tubular string handled by the rig.

A method and assembly for casing handling using a kelly rig may be of interest. Any such method and/or assembly may be selected to apply torque to and react torque from a string of one or more joints of casing.

SUMMARY

A method for handling casing using a kelly rig is considered herein. A rig assembly for casing handling is also considered herein.

In accordance with one aspect of the present invention, there is provided a method for converting a kelly rig for operation to handle casing, the method comprising: providing a rig including a rig floor, a derrick extending upwardly from the rig floor and a hook suspended from the derrick; providing a torque generating device and a casing engaging device supported on the hook, the torque generating device selected to drive the casing engaging device to rotate and the casing engaging device selected to engage a casing joint; installing a drill collar stand extending substantially parallel to the hole center axis to form a torque reaction guide extending upwardly above the rig floor and in force communication with the rig; and securing a torque frame between the torque generating device and the drill collar stand to transfer forces from the torque generating device to the drill collar stand and therethrough to the rig.

In accordance with another aspect of the present invention, there is provided a rig assembly for handling casing, the rig assembly comprising: a rig including a rig floor, a derrick extending upwardly from the rig floor, a monkey board and a hook suspended from the derrick; a torque generating device and a casing engaging device supported on the hook, the torque generating device selected to drive the casing engaging device to rotate and the casing engaging device selected to engage a casing joint; a torque reaction guide including a drill collar stand substantially parallel to hole center axis and extending upwardly above the rig floor and in force communication with the rig; a torque frame between the torque generating device and the torque reaction guide to transfer forces from the torque generating device to the drill collar stand and therethrough to the rig.

In accordance with another aspect of the present invention, there is provided a method for converting a kelly rig for operation to handle casing, the method comprising: providing a rig including a rig floor, a derrick extending upwardly from the rig floor and a hook suspended from the derrick; providing a torque generating device and a casing engaging device supported on the hook, the torque generating device selected to drive the casing engaging device to rotate and the casing engaging device selected to engage a casing joint; installing an elongate member selected from the group consisting of a drill pipe stand, a casing string or a cable in tension, extending substantially parallel to the hole center axis to form a torque reaction guide extending upwardly above the rig floor and in force communication with the rig; and securing a torque frame between the torque generating device and the elongate member to transfer forces from the torque generating device to the elongate member and therethrough to the rig.

In accordance with another aspect of the present invention, there is provided a rig assembly for handling casing, the rig assembly comprising: a rig including a rig floor, a derrick extending upwardly from the rig floor, a monkey board and a hook suspended from the derrick; a torque generating device and a casing engaging device supported on the hook, the torque generating device selected to drive the casing engaging device to rotate and the casing engaging device selected to engage a casing joint; a torque reaction guide including an elongate member selected from the group consisting of a drill pipe stand, a casing string or a cable in tension, substantially parallel to hole center axis and extending upwardly above the rig floor and in force communication with the rig; a torque frame between the torque generating device and the torque reaction guide to transfer forces from the torque generating device to the torque reaction guide and therethrough to the rig.

In accordance with another aspect of the present invention, there is provided a method for converting a kelly rig for operation to handle casing, the method comprising: providing a rig including a rig floor, a derrick extending upwardly from the rig floor and a hook suspended from the derrick; providing a torque generating device and a casing engaging device supported on the hook, the torque generating device selected to drive the casing engaging device to rotate and the casing engaging device selected to engage a casing joint; installing a first elongate member extending substantially parallel to the hole center axis to form a torque reaction guide extending upwardly above the rig floor and anchored to the monkey board to be in force communication with the rig; and securing a torque frame between the torque generating device and the torque guide to transfer forces from the torque generating device to the torque reaction guide and therethrough to the rig.

In accordance with another aspect of the present invention, there is provided a rig assembly for handling casing, the rig assembly comprising: a rig including a rig floor, a derrick extending upwardly from the rig floor, a monkey board and a hook suspended from the derrick; a torque generating device and a casing engaging device supported on the hook, the torque generating device selected to drive the casing engaging device to rotate and the casing engaging device selected to engage a casing joint; a torque reaction guide installed substantially parallel to hole center axis and anchored adjacent its upper end to the monkey board and anchored adjacent its lower end adjacent the rig floor; a torque frame between the torque generating device and the torque reaction guide to transfer forces from the torque generating device to the torque reaction guides and therethrough to the rig.

In accordance with another aspect of the present invention, there is provided a torque transfer frame for use in a rig to convey torque from a torque generating device acting on a drill string to a torque reaction guide installed in the rig, the torque transfer frame comprising: an input end for connection directly or indirectly to a torque generating device suspended in a rig; a torque transfer end for connection directly or indirectly to a torque reaction guide installed in a rig; a hydraulic cylinder between the input end and the torque transfer end, the hydraulic cylinder being operable to permit spacing adjustment between the input end and the torque transfer end and being controllable to lock the hydraulic cylinder to a selected spacing between the input end and the torque transfer end and to transfer torque therealong from the input end to the torque transfer end.

In accordance with another broad aspect of the present invention, there is provided a torque transfer assembly for use in a rig to react forces generated from torquing casing to the rig, the torque transfer assembly comprising: a torque generating device suspended in the rig over the rigs well center axis and capable of acting on a casing joint to apply torque thereto, a torque reaction guide installed in the rig including an elongate member extending upwardly in the rig substantially parallel with the well center axis; a torque transfer frame including an input end for connection directly or indirectly to the torque generating device, a connector slidably connected to the elongate member, an apparatus for restraining the connector from rotating freely about the elongate member and a length adjustable and releasably lockable member between the input end and the connector, the length adjustable and releasably lockable member being operable to permit spacing adjustment between the input end and the connector and being controllable to become releasably locked into a selected spacing between the input end and the connector.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
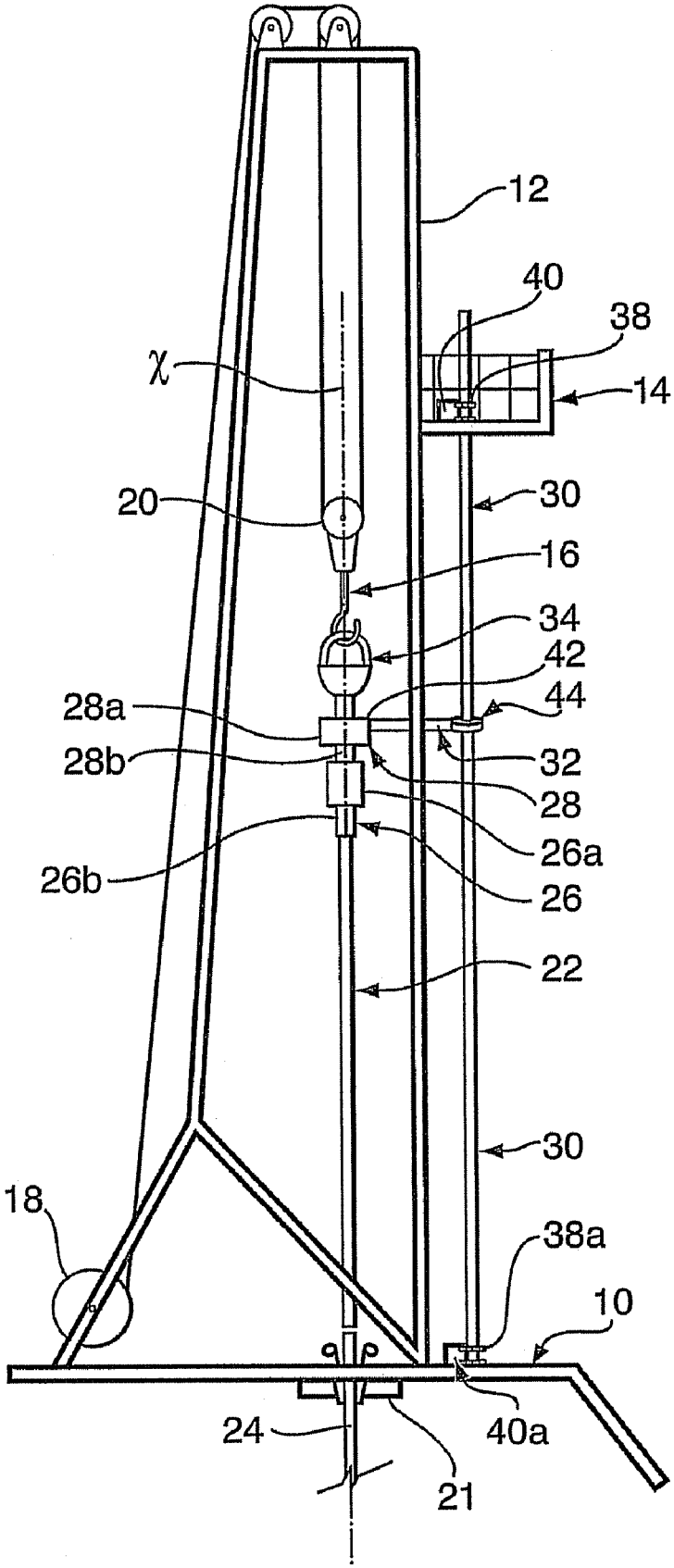
FIG. 1 is a side view of rig including a casing handling assembly.
Figure 2:
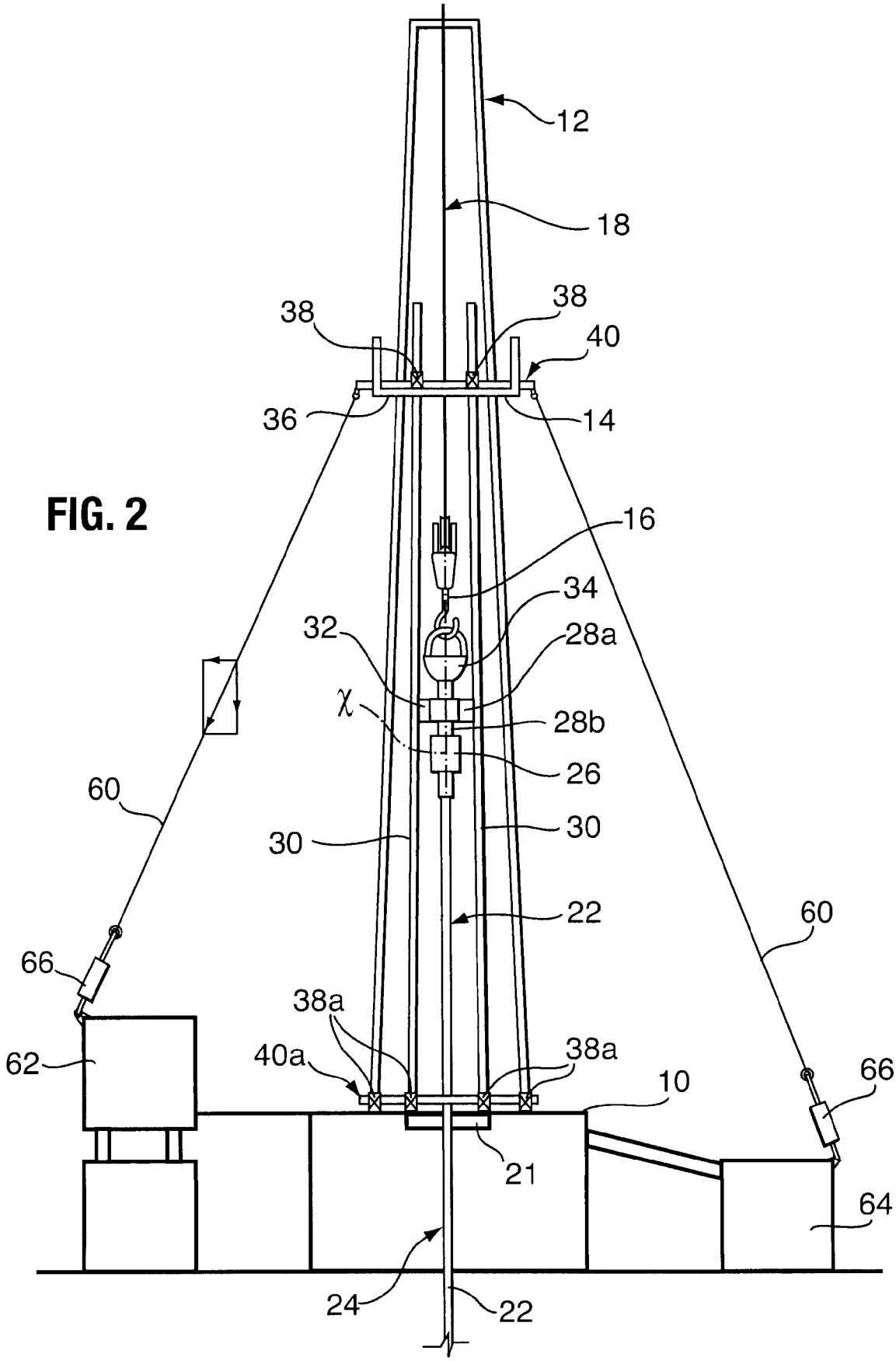
FIG. 2 is a front view of a rig including a casing handling assembly.
Figure 3:
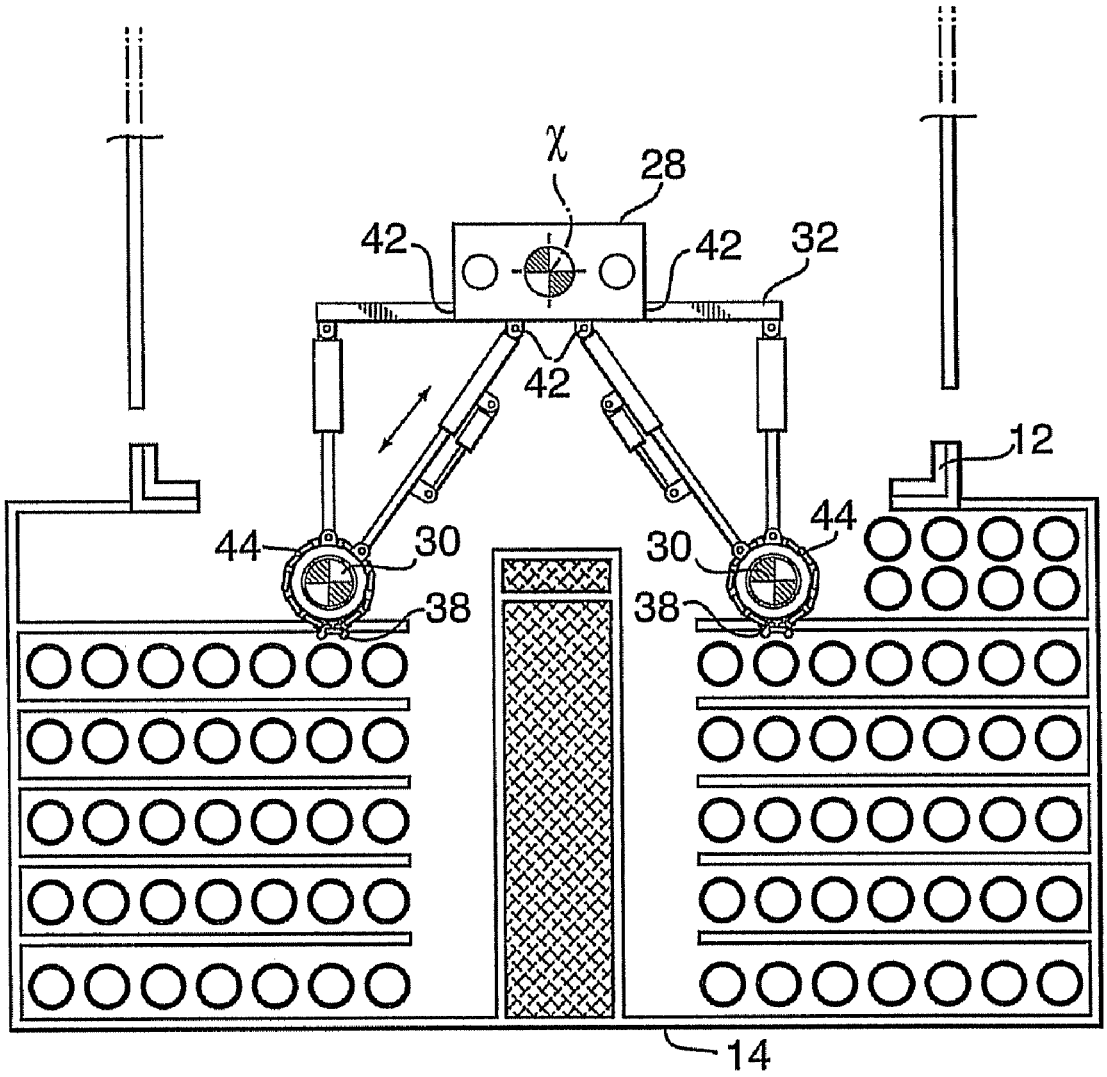
FIG. 3 is a plan view of a torque frame mounted adjacent a monkey board on a rig.

With reference to FIGS. 1 to 3, a drilling rig may generally include: a rig floor 10, a derrick 12 extending upwardly from the rig floor, a monkey board 14 in the derrick spaced above the rig floor and a hook 16 suspended from the derrick, as by use of a drawworks, generally indicated at 18, and a block 20. As a kelly rig, the illustrated derrick is generally operated by use of a rotary table 21 on the rig floor and a by use of a kelly and a kelly bushing, which have been removed in the illustrated derrick.

To run casing into a wellbore, a plurality of casing joints 22 are connected into a string, a portion of which is shown at 24, and the string is generally manipulated rotationally and axially at surface to be pushed, slid, reamed or drilled into a wellbore. In one embodiment, casing may be run using a casing engaging device 26, a torque-generating device 28, a torque reaction guide 30 and a torque frame 32.

Casing engaging device 26 permits a casing joint or string to be engaged and supported in the derrick. Casing engaging device 26 may be suspended by a swivel 34 below the hook. Many casing engaging devices are known. Casing engaging devices may use various engaging configurations including any of expandable engaging members, slips, inflatable members, threaded connections or extruded materials, etc., to engage a casing joint on its outer surface or inner diameter to impart axial and rotational drive thereto. Casing engaging devices may therefore be used to lift and support the casing and rotate it for making and breaking connections and possibly for reaming or drilling it into the borehole. Some embodiments of casing engaging devices are, for example, available from Tesco Corporation and know as their external or internal Casing Drive System™ (CDS) tools. In the illustrated embodiment, an internal CDS casing gripping tool with an actuator 26*a* and a gripping spear 26*b* is employed.

In standard drilling rigs when a casing drive tool is used, a top drive is generally used to generate and apply torque to the casing string being handled. Torque-generating device 28 useful in the present invention may be a top drive. However, generally a top drive may not be readily available or may be too large to be conveniently used on a kelly rig. Thus, in one embodiment torque generating device 28 may be in the form of a "casing spinner" to spin and torque casing joints. The casing spinner may, for example, include a gear box and a motor 28*a* and a quill 28*b* acted upon to rotate by the gear box and motor, but need not include many of the additional components that add to the complexity, size and cost of a top drive such as the pipe handlers, link hangers, etc. A motor, such as one or more hydraulic motors, may be used for imparting drive to the gear box and the quill. The gear box could be designed to be much lighter than a top drive gear box because the service factor can be much less, more like a torque generating mechanism of a power tong. Generally, a motor and gear box capable of generating the horse power of a power tong, such as 5 to 15 hp may be useful, although a motor and gear box capable of generating between 5 and 250 hp, for example between 50 and 200 hp, may offer greater functionality. Where a spinner is used, it may also provide the functionality of a power tong such that a power tong and a tong operator, may be eliminated if desired. However, the spinner may be selected to provide capacity to ream casing into the hole, something a power tong could not do. The casing spinner is attached between swivel 34 and casing engaging device 26.

Torque reaction guide 30 may include one or more elongate members mounted in the derrick to extend up from the rig floor substantially parallel with hole center axis x. Torque reaction guide 30 could, of course, be a torque tube or torque track such as are normally used with top drives. However, the use of a torque tube may be cost prohibitive and considerable effort may be required to rig up a torque tube for small casing handling jobs. It is more desirable to use equipment that is already available on a drill site. The elongate members of the torque reaction guide should be more than about 42 feet long (which is the length of a single joint of casing) and have considerable bending strength when installed such that they are capable of reacting the forces generated by the casing spinner without significant bending or breaking. In one embodiment, torque reaction guide 30 may include one or more elongate members selected from materials on the drill site. For example, the elongate members may be selected from one or more of a drill pipe stand, a short casing string, a cables secured in tension (although the use of cables alone may require at least two cables), etc. However, each of these options present difficulties such as with drill pipe, the inclusion of tool joints which may hinder travel of a torque frame along the drill pipe; with casing, the complication of needing to torque up the casing before it can be used and the inclusion of the coupling upset that again may hinder travel of the torque track; and with cables, their inherent flexibility and ability to twist and considerable axial loads that may be transferred to the derrick. In one embodiment, for example, torque reaction guide may include one or more drill collar stands. The stands are already available on the rig and most likely already standing in the derrick, having been removed from the hole in preparation for running casing. In use, the drill collar stand may set up adjacent well center. The drill collar may already be in a suitable position standing in the monkey board. However, in some embodiments appropriate set up may require repositioning of the drill collar within the monkey board or from the monkey board to another position in the derrick. The drill collar stand may be securely and conveniently anchored to extend from a position adjacent the rig floor level up into the derrick. The drill collar stand may each be anchored at at least its upper end at the rig's monkey board 14 or at another position elevated in the derrick, for example to one of the derrick legs.

In one embodiment, shown in FIGS. 1 and 2, a pair of drill collars 30 may be used for form the torque reaction guide. Each drill collar stand 30 is an elongate member. Generally, there should be enough room to locate two drill collar stands as shown in FIGS. 1 and 2. Setting up the drill collar stands substantially parallel to well center should be reasonably easy to accomplish, but care may be taken to ensure that any guide 30 does not create a hazard on the drill rig. Although other configurations and modes of securing are possible such as by relying on their weight to anchor the drill collars at their lower ends, in the illustrated embodiment, the stands 30 are secured to monkey board 14 or to one of the derrick legs, for example, as by use of one or more of chains 38, clamps, cross beams 40, etc. and adjacent rig floor 10 to derrick 12 as by use of one or more of chains 38*a*, adjustable clamps, cross beams 40*a*, etc. It may be desirable to simplify the installation and the requirements for the torque reaction guide such that the installation time and knowledge required can be reduced as much as possible. Generally, it is desirable to take advantage of anchor points already available on the rig, for example, on the rig floor and monkey board without over consideration to alignment to well center or between the elongate members of the torque reaction guide.

Torque frame 32 is useful to transfer the reactive torque from casing spinner 28 to torque reaction guide 30 and ultimately to the derrick. As such, the torque frame is connected between the casing spinner and the torque reaction guide and includes an input end or a connection 42 directly or indirectly to the casing spinner, through which torque will be input to the frame, and a torque transfer end or connection 44 directly or indirectly for sliding engagement with the torque reaction guide, through which forces such as torque and/or side forces will pass from the frame into torque reaction guide 30. Torque frame 32 moves with the casing spinner as it is moved vertically by the drawworks and therefore connection 44 between the torque frame and the torque reaction guide secures the parts together but permits the frame to slide along the torque reaction guide. Torque frame also provide for transfer of forces to the torque reaction guide, such as by limiting rotation of the torque frame relative to the torque reaction guide. Such a capability may be provided by the torque frame engaging the torque reaction guide, as by use of gripping devices drivable into engagement with the torque reaction guide. Such a capability may alternately or in addition be provided by providing the frame and torque reaction guide to act with a dual anchor point, such as may be provided by connecting the frame in two positions horizontally spaced positions on the torque frame.

Figures 4A, 4B:
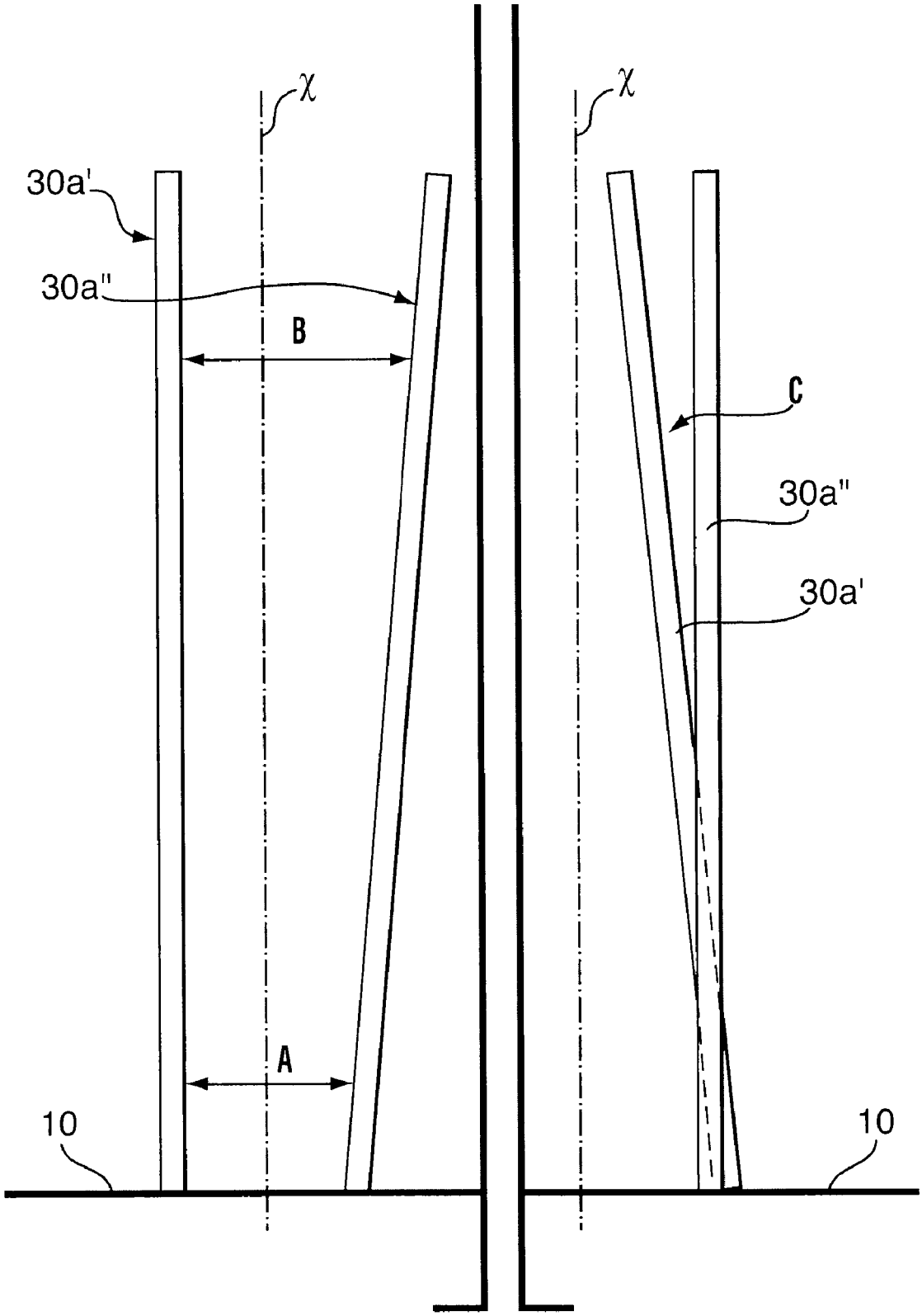
FIGS. 4A and 4B are schematic views showing possible misalignment of a torque reaction guide rail that may be encountered in the present invention.

The torque frame should be adjustable to a wide variety of different geometries, which will depend on the rig design. Also, the torque frame should be able to accommodate variances in the position and alignment of the torque reaction guide, including any elongate members thereof, relative to the well center axis. For example, the elongate member or members used to form the torque reaction guide may not be parallel with the well center line and, if two elongate members are used (as shown in FIGS. 1 to 5) to form the torque reaction guide, those elongate members, such as drill collar stands, may not be perfectly parallel to each other. Examples of such variances are shown in FIGS. 4A and 4B, which illustrates a situation where a pair of drill collar stands 30*a*', 30*a*" are used as the torque reaction guide and positioned relative to well center x. As an example, drill collar stands 30*a* have been installed in a configuration purposefully or unintentionally generating misalignment from at least two directions. For example, in the illustrated situation, the distance between stands 30*a* is less at the bottom, distance A, than at their upper ends, distance B. Also, in side view, the stands are out of alignment at C and the distance from one of stands 30*a*' to well center x becomes less with their height from rig floor 10.

Since it may be useful to minimize the requirements for mounting the torque reaction guide, such that its installation does not require significant time spent in alignment, it may be useful that the torque frame be configured to handle this misalignment. The frame may be able to "float" during part of the operation, when riding along the torque rail for example, and be rigid during the make-up operation, to actually react the forces generated by casing spinner 28. The torque frame may, for example, include hydraulic circuits to accomplish both flexible and rigid configurations.

Figure 5:
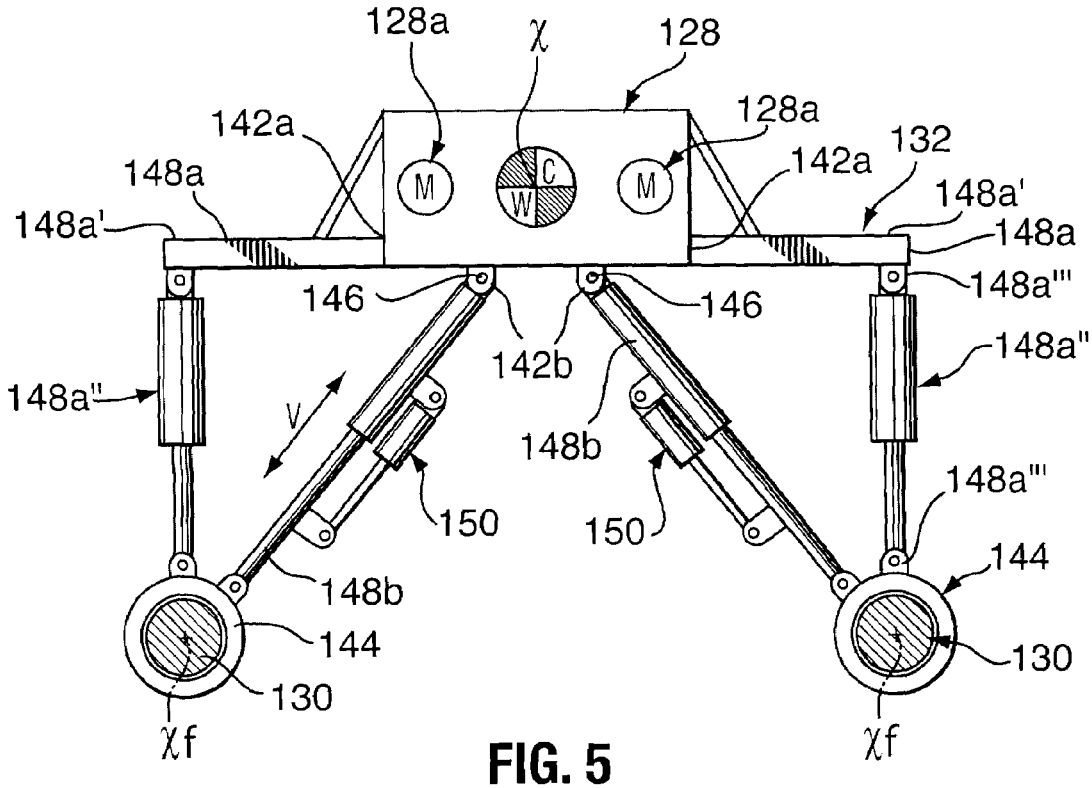
FIG. 5 is a top plan view of a torque frame according to one aspect of the present invention.

One possible embodiment of a torque frame 132 is shown in FIG. 5. Torque frame 132 is useful with a torque reaction guide including two elongate members. The illustrated torque frame includes a plurality of connections 142*a*, 142*b* to casing spinner 128, which is suspendable over well center x. Casing spinner 128 is illustrated as having two motors 128*a*. Connections 142*a* are rigid, as by use of welds, bolts, rivets, etc. while connections 142*b* hold spinner 128 and frame 132 together securely but include a pivotal connection 146 for permitting rotation at the connection through a plane substantially orthogonal relative to the axial direction xf through connections 144. Connections 142*a*, 142*b* permit frame 132 to move axially with the casing spinner as it is moved by the drawworks.

The illustrated torque frame also includes a slidable connection to the torque reaction guide, which in this embodiment includes a slidable connection 144 to each of two spaced apart drill collar stands 130 mounted in the derrick. Slidable connection 144 can be a collar, bushing or other item that connects the frame to the torque reaction guide such that forces including torque and/or side load can be transferred therethrough but that permits the frame to slide up and down along the guide, again as would be driven by movement of the casing spinner. Slidable connections 144 may be formed to fully encircle the elongate members, as shown, or can be C-shaped if desired provided that they remain secured to the elongate member during use. The slidable connections can each be openable such as by use of hinged connections or multipart arrangements to facilitate connection about the stands 130 and may be diameter adjustable to fit about members of various outer diameter.

Cross members 148*a* connect between connections 142*a* and 144 and cross members 148*b* connect between connections 142*b* and 144. The illustrated torque frame includes hydraulics along cross members 148*a*, 148*b* to retain communication between connections 142*a*, 142*b* and connections 144 but to permit the torque frame to operate in two basic "modes": "float" and "freeze". In particular, cross members 148*a* include a rigid portion 148*a*' and a hydraulic cylinder portion 148*a*" such that the distance between each connection 142*a* and its corresponding connection 144 can be varied. Of course, inclusion of hydraulic cylinder portion 148*a*" may include pivotal mounts 148*a*'" at each end to permit operational drive of the ram of the cylinder. Cross members 148*b* may also be varied in length between their connections 142*b* and 144, as for example, by use of telescopically moveable parts and a hydraulic ram 150 acting to move the parts relative to each other to adjust along arrow V. Cross members 148*b* may be formed of telescopically moveable parts that reduce torsion about their long axis. For example, cross members 148*b* may be formed of square tubing to reduce relative rotation between the parts. This may offer some resistance against twisting of frame 132 out of plane.

"Float" and "freeze" modes may be useful. "Float" mode may work through open hydraulic circuits wherein oil is allowed to freely pass from one side of a cylinder to the other side, and possibly to other cylinders on the frame. Of course there would be some flow resistance but that beneficially act as a dampener so that the assembly does not readily swing. The "float" mode allows the frame to adjust to any misalignment in drill collar stands 130 as the casing spinner, and therefore the torque frame, moves up and down along the torque reaction guide, for example, when joint 22 is engaged by the casing engaging device and is pulled up into the derrick. The float mode allows the torque frame to adjust so that the casing spinner and frame automatically move, by weight of anything suspended from the hook, toward alignment with the well centerline.

"Freeze" mode may be achieved by closing the valves in the cylinder hydraulic circuits such that the hydraulic fluid is trapped wherever it is in all cylinders 148*a*" and 150, on both sides. "Freeze" may be activated automatically in the system whenever the operator activates the casing spinner for spinning or torquing.

Such modes in the illustrated embodiment operate by use of at least one cylinder between the frame and a first of the pair of drill collar stands and at least one cylinder between the second of the pair of drill collar stands. The illustrated embodiment shows two additional adjustable struts including hydraulic cylinders to further assist with torque reaction and frame operation.

In such an embodiment, a pair of the cylinders, for example, the diagonal cylinders 150 can be activated to align the casing joint correctly for proper thread engagement. This may eliminate the need for a workman in the derrick, which may offer a safety benefit. The two cylinders and reaction against a torque guide with two spaced apart rails, as may be provided by the drill collars, may allow an operator to move the joint in any horizontal direction because the cylinders 150 act linearly between the casing diameter and the torque guide rails. In the illustrated embodiment, for example, the two cylinders 150 intersect the cross section of casing handled over well center x at substantially a 90-degree angle and the drill collars are positioned apart at a similar angle in relation to well center. In such an operation, the hydraulics may operate such that when the operator activates cylinders 150 the other torque rams 148*a*", revert to float operation, automatically. As soon as the operator activates the casing spinner all four rams go into "freeze" to resist the torque. It may be necessary to mount the cylinders using pivotal connections at their ends to enhance float, as may be appreciated.

Another advantage of having the rams as connections from the torque frame to the drill collars is that it ensures that the drill collars are loaded evenly, which may enhance the structural integrity of this assembly.

It will be appreciated that torque frame 132 could be modified to act with more than two elongate members such as by addition of further connections similar to connections 144.

Figure 6:
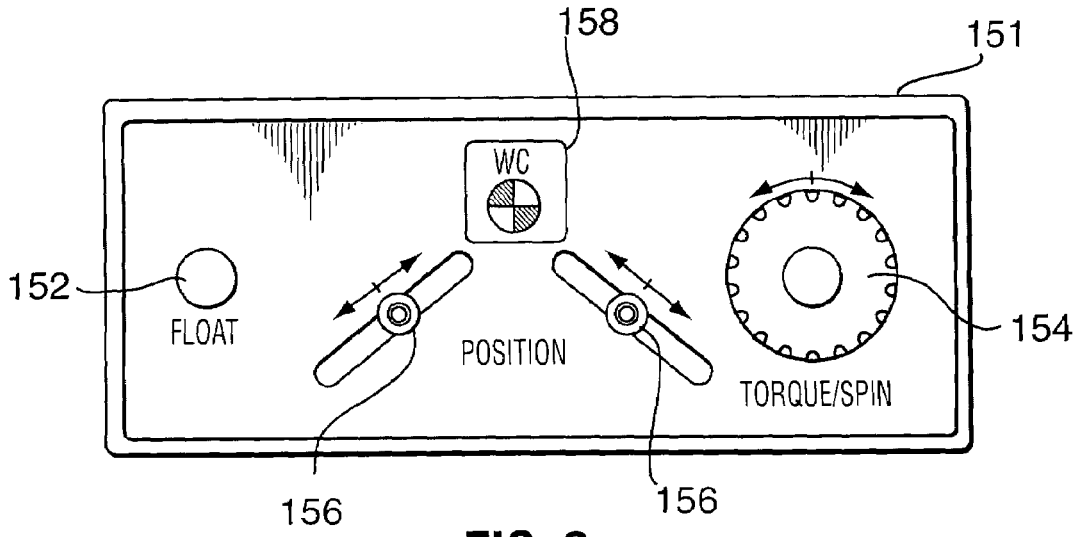
FIG. 6 is a control panel that may be useful for a casing handling assembly.

A control system may be provided to control operation of casing spinner 128 and torque frame 132. One possible embodiment of a control panel 151 for a control system is illustrated in FIG. 6. A control system may include for example, a selector 152 for placing the frame in "float" mode and a selector 154 for causing the casing spinner to spin the casing engaging device. The control system may cause frame 132 to move to "freeze" mode when selector 154 is actuated to drive casing spinner 128. A control system may also include actuators 156 to drive movement of rams 150 to select the position of casing spinner relative to well center. A control system may include a feedback mechanism, which determines and shows the position of the casing spinner relative to well center on a display 158. Of course, many other control features and panel configurations may be possible.

Figure 7A:
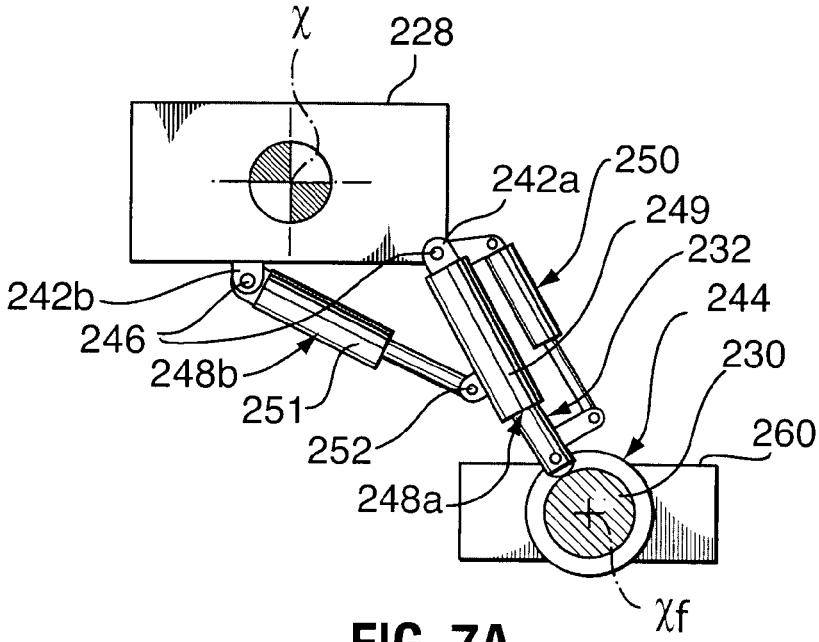
FIGS. 7A and 7B are top plan and side elevation views of an installed torque frame according to one aspect of the present invention.
Figure 7B:
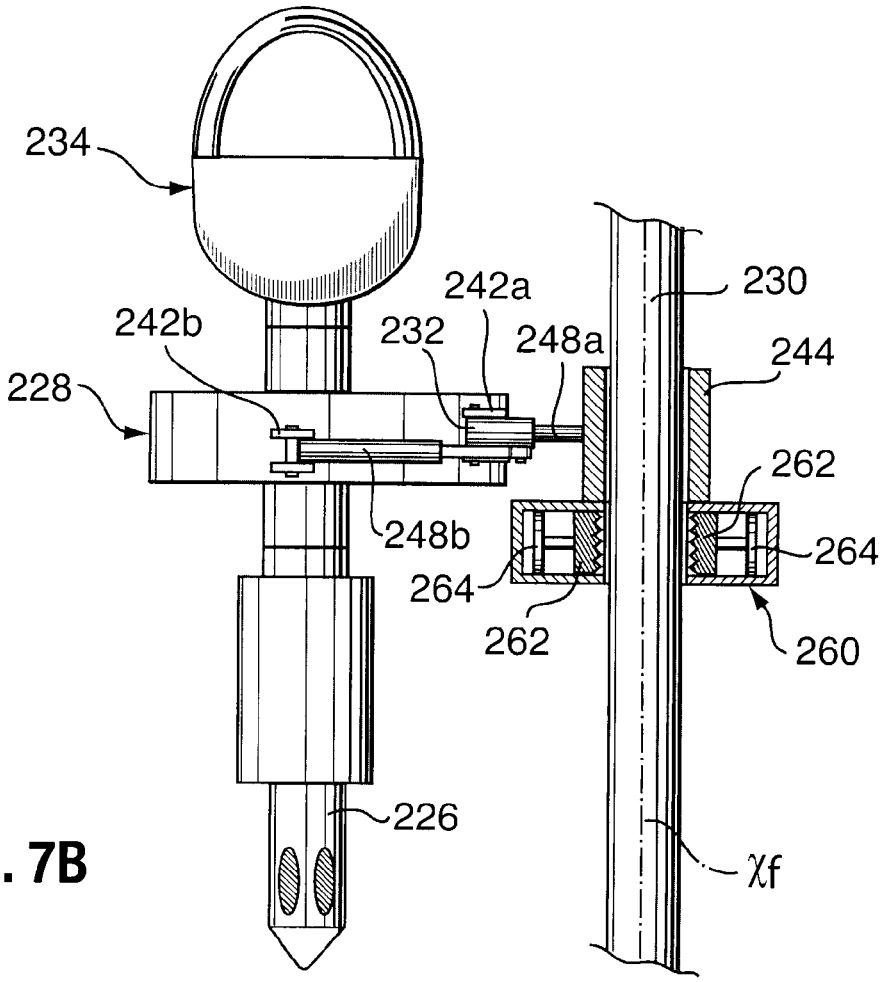

Another example embodiment of a torque frame 232 is shown in FIGS. 7A and 7B. Torque frame 232 is useful with a torque reaction guide including a single elongate member and can accommodate operation with a cylindrical elongate member, such as a drill collar stand. The illustrated torque frame includes connections 242*a*, 242*b* to a torque generating device 228, which is suspendable over well center x. Connections 242*a*, 242*b* hold device 228 and frame 232 together securely but include pivotal connections 246 for permitting rotation at the connections through at least parallel planes substantially orthogonal to well center axis x. Connections 242*a*, 242*b* permit frame 232 to move axially with the casing spinner as it is moved by the drawworks.

The illustrated torque frame also includes a slidable connection to the torque reaction guide, which in this embodiment includes a slidable collar connection 244 to drill collar stand 230 mounted in the derrick. Slidable collar connection 244 can be a collar, bushing or other item that connects the frame to the torque connection such that forces can be transferred therethrough but that permits the frame to slide up and down along the connection, again as would be driven by movement of device 228. Slidable connection 244 may be formed to fully encircle the elongate member, as shown, or can be C-shaped, if desired, provided that it remains secured to the elongate member during use.

A cross member 248*a* connects between connections 242*a* and 244 and a cross member 248*b* connects between connection 242*b* and cross member 248*a*. The illustrated torque frame includes mechanisms along cross members 248*a*, 248*b* to retain communication between connections 242*a*, 242*b* and 244 but to permit the torque frame to have an adjustable spacing between its connection to the torque generating device and its engagement of the drill collar stand such that the frame can be operated in two basic "modes": "float" and "freeze". In particular, cross members 248*a*, 248*b* each include mechanisms for length adjustment so that distance and angular orientation between connections 242*a*, 242*b* and connection 244 can be adjustable.

In the illustrated embodiment, cross member 248*a* includes a telescopically moveable part 249 and a hydraulic ram 250 acting to move the sections of part 249 relative to each other to adjust its length between connections 242*a* and 244. Cross member 248*a* may be formed of telescopically moveable parts that reduce torsion about their long axis. For example, cross members 248*a* may be formed of square tubing to reduce relative rotation between the parts. Since frame is generally desired to be maintained to extend in a plane substantially orthogonal with the axial direction xf through connection 244, this may offer some resistance against twisting of frame 232 out of plane.

Cross member 248*b* may include a hydraulic cylinder portion 251 that can be driven to drive cross member 248*a* about its pivotal connection 242*a* to device 228, to adjust the angle of member 248*a*, and therefore connection 244, relative to device 228. Of course, inclusion of hydraulic cylinder portion 251 necessitates a pivotal mount 252 to cross member 248*a* to permit operational drive of the ram of the cylinder.

"Float" and "freeze" modes may be useful. "Float" mode may work through open hydraulic circuits wherein oil is allowed to freely pass from one side of each cylinder to its other side, and possibly to the other cylinder on the frame. Of course there would be some flow resistance but that beneficially may act as a dampener so that the assembly does not readily swing. The "float" mode allows the frame to adjust to any misalignment between drill collar stand 230 hole center x as the torque frame moves up and down along the drill collar, for example, when a casing joint engaged by the casing engaging device and is pulled up into the derrick. The float mode allows the torque frame to adjust so that device 228 and frame 236 automatically move toward alignment with the well centerline, by the weight of swivel 234, device 228, casing engaging device 226, a casing joint hanging from device 226 and anything else suspended from the hook.

"Freeze" mode may be achieved by closing the valves in the hydraulic circuits such that the hydraulic fluid is trapped wherever it is in cylinders 250, 251 on both cross members and their respective lengths are thereby locked. "Freeze" may be activated selectively or possibly automatically in the system whenever the operator activates the torque generating device for spinning or torquing.

Since a stand 230 is substantially cylindrical in form, connection 244 may tend to turn on the drill collar stand, rather than properly providing a transfer of forces. To ensure that forces from device 228 are transferred to stand 230, connection 244 may be selected to be rotationally lockable to the drill collar stand. For example, as shown, connection 244 be axially and rotationally secured to a grabber 260 that also may be installed to ride slidably along drill collar 230, but that includes engaging devices 262 that may be operated to grip the drill collar to prevent at least rotational movement of the grabber, and therefore connection 244, about collar 230. As such, frame 232 including connection 244 and grabber 260 may be operated to permit torque to be transmitted from the torque generating device to the frame and into the drill collar.

Engaging devices 262 may be formed in various ways such as by teethed members, wheels, abrasive surfaces, elastomeric members, etc. Engaging devices 262, when engaged against drill collar, may at least act to resist rotation about collar 230. In one embodiment for example, engaging devices 262 may include teethed wheels or rollers mounted within the grabber and positioned to be in engagement with collar 230 during use to permit the grabber to slide, as by riding on the wheels, along the drill collar but prevent rotational movement of grabber 260 about the collar by the teeth biting into the material of the collar.

However, in some embodiments, engaging devices 262 may also, when engaged, act against axial movement of grabber 260, and therefore connection 244, along collar 230. One such embodiment may for example include the use of devices such as tong dies or gripping slips as engaging devices 262. In such an embodiment, engaging devices 262 of the grabber may be operated selectively, as by use of hydraulics 264, to grip and release the drill collar. For example, in such an embodiment, it is necessary to release devices 262 from engagement of the collar when it is desired to move device 228 up and down in the rig. For example, it may be desirable to grip the drill collar against rotational movement when reacting torque from the torque generating device and release it at other times. In such an embodiment, the engaging devices 262 may be connected to grip only when the frame is in "freeze" mode. Such a capability for grabber 260 to grip and release collar, may also be useful even when the engaging devices are selected only to act against rotation.

With frame 232, one or both cylinders 250, 251 can be activated to align the casing joint correctly for proper thread engagement during stabbing of a casing joint to one supported in the drill floor. This may eliminate the need for a stabbing guide and/or a workman in the derrick, which may offer a cost and safety benefit. The two cylinders and reaction against the drill collar by action of grabber 260, may allow an operator to move the joint in any horizontal direction because the cylinders act cooperatively to position device 236 and at various different distances and angles relative to the torque reaction guide.

A control system may be provided to control operation of the torque generating device and torque frame 232. Control of frame 232 may be facilitated by the use of a PLC or other logic devices.

With the use of a single drill collar stand as shown in FIGS. 7A and 7B, set up may be facilitated over that embodiment shown in FIGS. 1 to 5 since only one drill collar need be positioned and anchored. The drill collar stand may be anchored at the monkey board or at another position in the derrick and because of the float feature of the frame need not extend exactly parallel to well center. Also, the transmission of forces from the torque generating device to the drill collar will be more torque than side load. Since side loads may be minimal, the drill collar stand may be simply torque restrained at the drill floor. A torque restraint, for example, may extend on the off drillers side to an anchoring position on a derrick leg and, therefore, reduce the tripping hazard over a system that installs a cross beam on the rig floor.

Care may be given to the direction of torque transmitted to the drill collar to avoid the risk of the drill collar stand connection breaking out. However, such a risk may be reduced by consideration of the torque force being transmitted and by observation of movement of the structures supported by the hook during torquing of the casing string. If using a set up such as that shown in FIGS. 1 and 2 using a pair of drill collars and depending on how much torque the derrick can withstand on it's own, torque wires 60, as shown in FIG. 2, may be useful to distribute torque load. Most derricks are not designed to take much torque beyond wind load and drill string set back loads. Unfortunately, the reactive torque from casing running tools add to the torque exerted by the setback of the drill string when the pipe is racked on the off-drillers side, which is most common on land rigs. Only one of many possible configurations of the installation of torque wires 60 is shown. As an example, in one other embodiment, it may be more beneficial to anchor one or more wires to any or all of the end of the catwalk, towards the back end of the rig, for example to the pump house or generator building, to the dog house 62 or to a mud tank 64, etc. The use of torque wires 60 may allow a torque transfer connection further out from well center x. Positioning the wires out as far as possible provides the wires with a much better angle to act on. Hydraulic rams or other linear tensioners 66 could be mounted in the lines. In one embodiment, rams 66 may be selected to respond to the pressure in the casing spinner. In such an embodiment, lines 60 may be driven by rams 66 to tighten up in direct relation to the torque exerted on the derrick by the casing spinner. Although the rams are shown near the bottom ends of the tensioning wires, the rams may alternately be located adjacent the monkeyboard end of the line since the hydraulic lines may have to come close to the monkeyboard as they go over the hang off saddle at the top of the standpipe. If alternately, a set up as disclosed in FIG. 7A is used, employing only a single elongate member, torque lines, such as those shown in FIG. 2, may not be needed as only very limited amounts of torque are transferred to the derrick.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A method for drilling and running casing into a well, the method comprising:

(a) providing a rig including a rig floor, a rotary table, a derrick extending upwardly from the rig floor and a hook suspended from the derrick;

(b) supporting with the hook a string of drill pipe that includes a plurality of drill collars and rotating the rotary table to drill the well with the string of drill pipe, and removing the string of drill pipe from the well once a total depth is reached;

(c) for running casing, providing a torque generating device and a casing gripping device supported on the hook;

(d) making up and installing from the string of drill pipe at least one drill collar stand to form a torque reaction guide extending upwardly above the rig floor and in force communication with the rig; and (e) securing a torque frame between the torque generating device and the drill collar stand to transfer forces from the torque generating device to the drill collar stand and therethrough to the rig;

(f) supporting a first joint of casing in the well with the rotary table;

(g) lifting a second joint of casing and positioning a lower end of the second joint of casing in engagement with an upper end of the first joint of casing, gripping a wall surface of the second joint of casing with the casing gripping device, and rotating the casing gripping device grippers and the second joint of casing with the torque generating device and reacting torque imposed to the drill collar stand to secure the second joint of casing to the first joint of casing; and (h) repeating steps (f) and (g) until the casing is installed in the well.

2. A rig assembly for handling casing, the rig assembly comprising:

a rig including a rig floor, a derrick extending upwardly from the rig floor, a monkey board and a hook suspended from the derrick;

a torque generating device and a casing gripping device supported on the hook, the torque generating device being selected to drive the casing gripping device to rotate, and the casing gripping device being selected to grip a casing joint;

a torque reaction guide including a drill collar stand from a string of drill pipe substantially parallel to a hole center axis, having a lower end supported on the rig floor and extending upwardly above the rig floor and in force communication with the rig; and a torque frame having one end connected to the torque generating device and another end in movable engagement with the torque reaction guide to transfer forces from the torque generating device to the drill collar stand and therethrough to the rig and to allow the torque frame to move relative to the drill collar stand up and down the derrick.

3. A method for converting a kelly rig for operation to handle casing, the method comprising:

providing a rig including a rig floor, a derrick extending upwardly from the rig floor and a hook suspended from the derrick;

providing a torque generating device and a casing gripping device supported on the hook, the torque generating device being selected to drive the casing gripping device to rotate, and the casing gripping device being selected to grip a casing joint;

installing an elongate member to form a torque reaction guide extending upwardly above the rig floor and anchored to the derrick to be in force communication with the rig;

securing a torque frame between the torque generating device and the torque guide to transfer forces from the torque generating device to the torque reaction guide and therethrough to the rig;

allowing a length of the torque frame to adjust as the torque generating device moves up and down the derrick to accommodate for different distances between the torque generating device and the torque reaction guide; and freezing the length of the torque frame to prevent any change when the torque generating device rotates the casing gripping device.

4. A rig assembly for handling casing, the rig assembly comprising:

a rig including a rig floor, a derrick extending upwardly from the rig floor, a monkey board and a hook suspended from the derrick;

a torque generating device and a casing gripping device supported on the hook, the torque generating device being selected to drive the casing gripping device to rotate, and the casing gripping device being selected to grip a casing joint;

a drill collar stand made up of a plurality of joints of drill collars from a string of drill pipe, the drill collar stand being anchored adjacent its upper end to the monkey board and having its lower end supported on the rig floor; and a torque frame connected to the torque generating device and in movable engagement with the drill collar stand as the torque generating device moves up and down the derrick, the torque frame transferring forces from the torque generating device to the torque reaction guides and therethrough to the rig while the torque generating device is rotating the casing gripping device.

5. A torque transfer frame for use in a rig to convey torque from a torque generating device acting on a drill string to a torque reaction guide installed in the rig, the torque transfer frame comprising: an input end for connection directly or indirectly to the torque generating device suspended in a rig; a torque transfer end for connection directly or indirectly to the torque reaction guide installed in the rig; a hydraulic cylinder between the input end and the torque transfer end, the hydraulic cylinder being operable to permit spacing adjustment between the input end and the torque transfer end and being controllable to lock the hydraulic cylinder to a selected spacing between the input end and the torque transfer end and to transfer torque therealong from the input end to the torque transfer end.

6. A torque transfer assembly for use in a rig to react forces generated from torquing casing to the rig, the torque transfer assembly comprising: a torque generating device suspended in the rig over the rig's well center axis and capable of acting on a casing joint to apply torque thereto, a torque reaction guide installed in the rig including an elongate member extending upwardly in the rig substantially parallel with the well center axis; a torque transfer frame including an input end for connection directly or indirectly to the torque generating device, a connector slidably connected to the elongate member, an apparatus for restraining the connector from rotating about the elongate member and a length adjustable and releasably lockable member between the input end and the connector, the length adjustable and releasably lockable member being operable to permit spacing adjustment between the input end and the connector and being controllable to become releasably locked into a selected spacing between the input end and the connector.

7. The assembly as in claim 6 wherein the torque reaction guide includes a second elongate member extending upwardly in the rig substantially parallel with the well center axis and spaced from the elongate member and wherein the apparatus for restraining the connector from rotating includes a second connector slidably connected to the second elongate member.

8. The assembly as in claim 6 wherein the apparatus for restraining the connector from rotating freely includes a grabber to engage the elongate member and secure the connector against rotational movement.

9. A method for running casing into a well with a kelly rig, the method comprising:

(a) providing the rig including the rig floor, a derrick extending upwardly from the rig floor and a hook suspended from the derrick;

(b) providing a torque generating device and a casing gripping device supported on the hook, the torque generating device being selected to drive the casing gripping device to rotate the casing gripping device, and the casing gripping device being selected to grip a casing joint;

(c) installing an elongate member to form a torque reaction guide extending upwardly above the rig floor and in force communication with the rig;

(d) securing a torque frame between the torque generating device and the elongate member, the torque frame having a plurality of fluid cylinders;

(e) supporting a first joint of casing in the well;

(f) lifting a second joint of casing by raising the hook, the torque generating device and the casing gripping device and positioning a lower end of the second joint of casing in engagement with an upper end of the first joint of casing;

(g) selectively operating the fluid cylinders of the torque frame to laterally move the casing gripping device and position the casing gripping device in alignment with an upper end of the second joint of casing, then gripping a wall surface of the second joint of casing with the casing gripping device; and (h) rotating the casing gripping device and the second joint of casing with the torque generating device and reacting torque imposed to the elongate member to secure the second joint of casing to the first joint of casing.

10. A rig assembly for handling casing, the rig assembly comprising:

a rig including a rig floor, a derrick extending upwardly from the rig floor, a monkey board and a hook suspended from the derrick;

a torque generating device and a casing gripping device supported on the hook, the torque generating device being selected to drive the casing gripping device to rotate and the casing gripping device selected to grip a casing joint;

a pair of torque reaction guides, each comprising an elongate member extending upwardly above the rig floor and in force communication with the rig;

a torque frame having an input end connected to the torque generating device and torque transfer ends in movable engagement with the torque reaction guides to transfer forces from the torque generating device to the torque reaction guides and therethrough to the rig;

the torque frame having hydraulic cylinders connected between the input end and the torque transfer ends, the hydraulic cylinders allowing lengths between the input end and each torque transfer end to vary to accommodate different distances between the torque reaction guides and the torque generating device as the torque generating device moves up and down the derrick; and a controller that locks the hydraulic cylinders and prevents any changes in length when the torque generating device is rotating the casing gripping device.

11. The method according to claim 1, wherein step (d) comprises securing an upper end of the drill collar stand at a monkey board located in the derrick and supporting a lower end of the drill collar stand on the rig floor.

12. The method according to claim 1, wherein:

step (d) further comprises making up and installing a second drill collar stand from the string of drill pipe, the second drill collar stand being spaced from said first drill collar stand and extending above the rig floor and in force communication with the rig; and step (e) further comprises securing the torque frame between the torque generating device and both of the drill collar stands to transfer forces from the torque generating device to the drill collar stands and therethrough to the rig.

13. The method according to claim 1, wherein:

step (e) comprises providing the torque frame with at least one fluid cylinder between the torque generating device and the drill collar stand;

allowing the fluid cylinder to increase and decrease in length to adjust for different distances between the torque frame and the drill collar stand while the torque frame moves up and down the derrick with the hook; and locking the fluid cylinder to prevent any change in length while rotating the casing gripping device and the second joint of casing with the torque generating device.

14. The rig assembly according to claim 2, further comprising:

a plurality of hydraulic cylinders incorporated with the torque frame for allowing a length between the ends of the torque frame to vary; and a controller that controls the plurality of hydraulic cylinders and selectively moves the casing gripping device laterally relative to a hole center axis.

* * * * *